US006105229A

United States Patent [19]

Sullivan

[11] Patent Number: 6,105,229

[45] Date of Patent: Aug. 22, 2000

[54] APPARATUS FOR SECURING TWISTED-PAIR ELECTRICAL CABLE TO A CONNECTOR

[76] Inventor: Robert W. Sullivan, 3310 Los Nogates Rd., Simi Valley, Calif. 93063

[21] Appl. No.: 09/097,065

[22] Filed: Jun. 12, 1998

Related U.S. Application Data

[62] Division of application No. 08/787,023, Jan. 28, 1997, Pat. No. 6,017,237.

[60] Provisional application No. 60/024,593, Aug. 26, 1996.

[51] Int. Cl.[7] ..... H01R 43/04

[52] U.S. Cl. ..... 29/33 M; 29/566.3; 29/749; 29/753

[58] Field of Search ..... 29/566.3, 566.4, 29/751, 753, 749, 33 M, 564.1, 564.8; 439/392

[56] References Cited

U.S. PATENT DOCUMENTS

| | | | |
|---|---|---|---|
| 3,845,535 | 11/1974 | Pzer | 29/749 |
| 4,040,179 | 8/1977 | Sanchez | 29/749 |
| 4,095,336 | 6/1978 | Throne | 29/749 |
| 4,219,913 | 9/1980 | Johnson, Jr. | 29/33 M |
| 4,326,767 | 4/1982 | Silbernagel et al. | 439/392 |
| 4,444,447 | 4/1984 | Markwardt | 439/392 X |
| 4,557,034 | 12/1985 | Pfundt | 29/566.4 |
| 4,597,158 | 7/1986 | Hirokawa et al. | 29/566.3 |
| 4,667,398 | 5/1987 | Leiby | 29/749 |
| 4,831,727 | 5/1989 | Johnson, Jr. et al. | 29/566.3 |
| 5,079,827 | 1/1992 | Meyer | 29/753 X |
| 5,109,591 | 5/1992 | Hung | 29/751 X |
| 5,357,669 | 10/1994 | Orphanos | 29/566.3 |

*Primary Examiner*—William Briggs
*Attorney, Agent, or Firm*—Gene W. Arent

[57] ABSTRACT

An apparatus for connecting a multi-wire-pair electrical cable to a connector housing with movable wire piercing contacts therein having input and output openings for the wires is disclosed. The outlet opening of the housing has a flat end face plate generally perpendicular to the longitudinal axis of the connector housing and to an anvil supported from the end of the housing. The apparatus comprises a crimping and shearing tool also having protrusions to drive the contacts into the wires of the cable. A shearing blade of the tool is positioned to wipe the flat end face plate of the housing to cut the wires flush with the end face plate.

2 Claims, 6 Drawing Sheets

APPARATUS FOR SECURING TWISTED-PAIR ELECTRICAL CABLE TO A CONNECTOR

This is a division of application Ser. No. 08/787,023 filed Jan. 28, 1997 U.S. Pat. No. 6,017,237. This application claims benefit of Provisional Appl. 60/024,593 filed Aug. 26, 1996.

FIELD OF THE INVENTION

This invention relates to installaton of wiring in electronic circuits that transmit data signals at very high rates.

BACKGROUND OF THE INVENTION

In data circuits for transmitting electronic signals at very high rates it has been necessary to convert the twisted-pair wiring of cable endings into flat-wired connections secured in a physical connector. When performing that operation it has been necessary to minimize the length of the flat wiring configuration as far as possible, so as to reduce cross-talk between circuits.

It has been the practice for the technician to remove the outer jacket insulation from an end portion of the cable, then to straighten out the protruding twisted wires each of which carries its separate insulation into a flat lateral configuration, and then to cut off the protruding wires and insert them into a connector. The connector is then crimped in order to securely attach the wires to respective terminals therein.

SUMMARY OF THE INVENTION

According to the invention an electrical connector which may be used in telephony and data applications for connecting a multi-pair electrical cable to an outlet has openings such that the wires can extend through it before they are cut off. The outer jacket insulation is removed from an end portion of the cable. The wires are arranged in an essentially flat configuration and inserted longitudinally into and through the connector, so that the respective wires extend through separate tracks and their end portions protrude from the forward end of the connector. The protruding wire ends are then compared with a standard to confirm the correct color identification pattern for them. After the comparison is made, the protruding wire ends are crimped/secured and sheared off.

According to the invention a novel crimping and shearing tool is provided, which crimps the connector so as to securely attach the wires to respective terminals therein, and at the same time shears off the protruding wire ends.

One advantage of the invention is that the protruding wire ends can be held and the electrical connector may be pulled tight before the wires are cut off, so as to minimize the length of straight wires on the input side of the connector, thus minimizing the cross-talk problem.

A further advantage of the invention is that the comparison of color codes of the protruding wire ends provides the technician a chance to correct any error that may have been made in establishing the sequence of wires within the connector. Thus, the error rate for erroneous connections is reduced.

Yet a further advantage of the invention is that less skill is required in order to correctly terminate the wires of a cable in a connector.

DRAWING SUMMARY

DESCRIPTION OF PRIOR ART

FIGS. 3 AND 4

Figure 4:
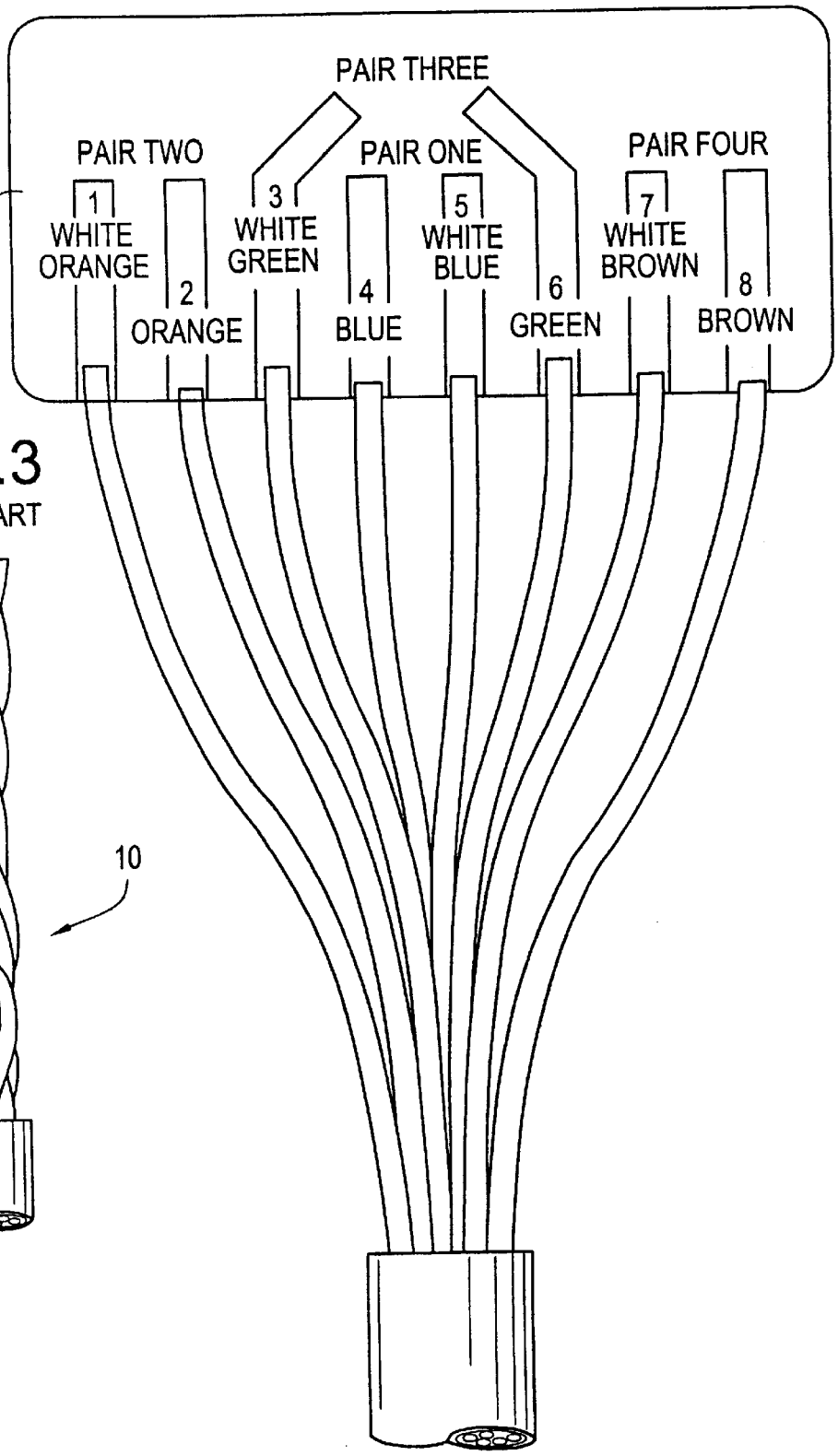
FIG.4 PRIOR ART
FIG. 4 is a plan view of a prior art fastener showing tracks into which the wire ends are inserted.
Figure 3:
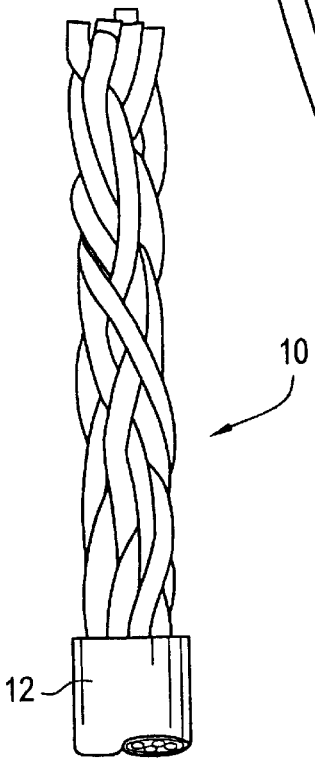
FIG.3 PRIOR ART
FIG. 3 shows a cable end carrying twisted-pair circuits with some of the jacket insulation removed before they are straightened into a flat configuration.

FIG. 3 shows a cable 10 that includes twisted-pair circuits. The outer insulation jacket 12 has been removed from an end portion of the cable, so that the individual wires may be straightened into a flat configuration, not specifically shown in FIG. 3. Although not specifically shown in that figure, the various wires of the cable have respectively different color codes. According to prior art methods the wires are straightened and are laid out in a side-by-side relationship that corresponds to a standard connector as shown schematically in FIG. 4. Then the ends of all the wires are cut off square with a hand-operated cutting tool, and all the wires are inserted at the same time into the tracks of the connector. FIG. 4 is a schematic plan view of a prior art fastener 14 showing the wire ends having thus been inserted into corresponding tracks of the fastener. As shown in FIG. 4, conductors 1 through 8 having different color codes are arranged in pairs One through Four.

A problem of the prior art technique is that the technician cannot clearly see or control the wire ends as they are inserted into the connector. It is therefore difficult to assure that the wires are arranged in a lateral sequence that correctly conforms the arrangement of the wires to the coding of terminals in the connector. A fairly high error rate is commonly experienced in making such connections.

DETAILED DESCRIPTION OF PREFERRED EMBODIMENT

FIGS. 1–3 AND 5–9

Figure 1:
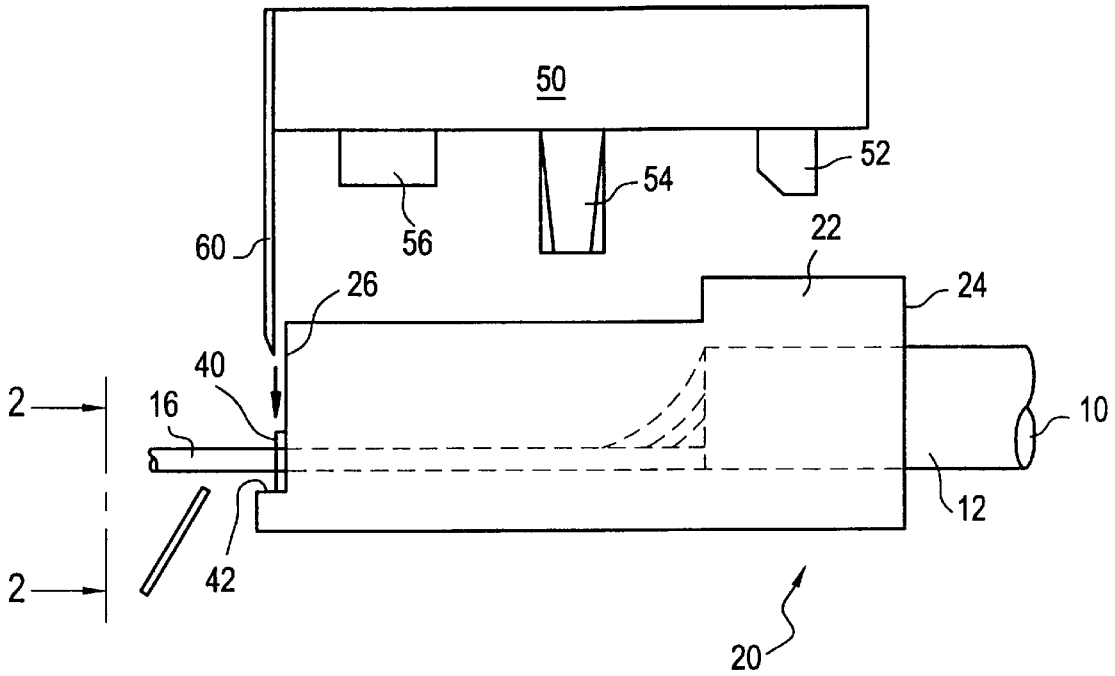
FIG. 1 is a schematic drawing of a connector and the upper part of a combined crimping and cutting tool in accordance with the invention.

FIG. 1 schematically illustrates both the novel method and the novel apparatus of the present invention. As shown in FIG. 1 an electrical connector 20 receives the end of a cable 10, and is adapted to be crimped by a crimping and shearing tool of which only the upper jaw 50 is shown. Downward movement of the jaw 50 will also shear off the protruding ends of the separate wires 16.

Figure 5:
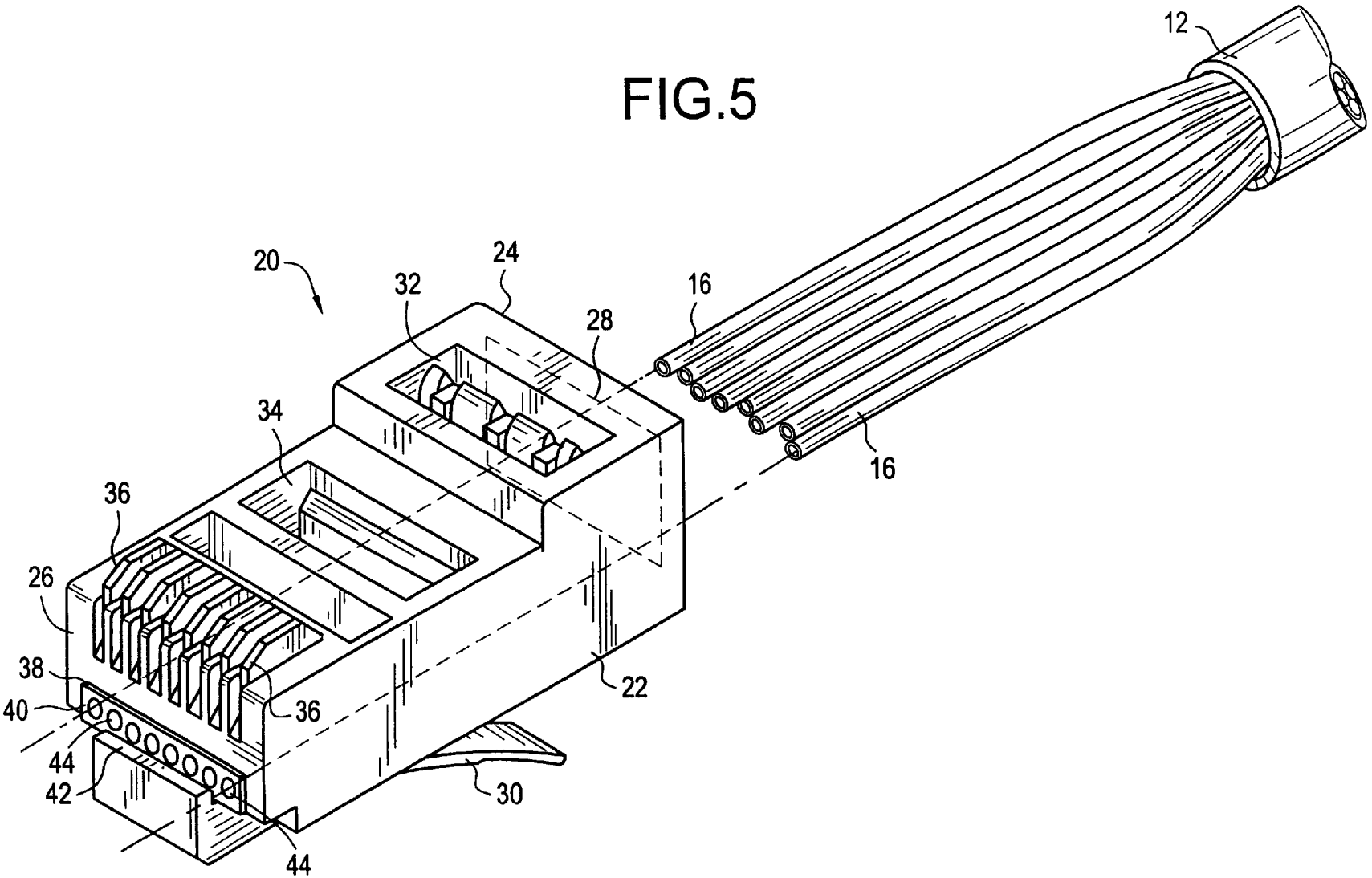
FIG. 5 is a perspective view of the novel connector provided in accordance with the present invention, and also showing the straightened wires of a cable ready to be inserted into and through the connector.

Before further describing FIG. 1, however, reference is now made to FIG. 5 which illustrates the connector 20 about to receive the prepared end of cable 10. As shown in FIG. 5, according to the present invention the length of insulation 12 of cable 10 that is removed is somewhat greater than in the prior art technique, in order to allow the wire ends to protrude through the connector. The electrical connector 20, which may be used in telephony and data applications for connecting a multi-pair electrical cable to an outlet, includes a plastic housing 22 having an input end 24 and an output end 26. An input opening 28 which is provided for receiving a plurality of insulated wires in an essentially flat parallel configuration extends through the housing and divides into parallel separate tracks for the respective wires which allow the ends 16 of the insulated wires to protrude from its output end.

A control tab 30 is provided on the bottom of the generally rectangular housing of the connector, for releasably latching it into an outlet, in a well known manner. The rearward end portion of the connector is somewhat thicker than the remainder of it, and on its upper surface there is a first recess 32 adapted for receiving a crimping force. A second recess 34 is located at about the longitudinal center of the connector, also for receiving a crimping force. The front end portion of the connector supports a plurality of metal contact plates 36 which are in spaced parallel relation, and which are supported in the housing in perpendicularly movable relation to the spaces that will become occupied by the insulated wires. The housing is crimpable and is adapted in response to the crimping action to cause the metal contacts to pierce the insulation coverings of and conductively engage the respective wires.

On its output or forward end the housing 22 has a flat face plate 38 which has a flat face 40 that is perpendicular to the longitudinal axis of the connector. Below the flat face 40 is a horizontal anvil surface 42. There are a horizontal row of eight openings 44 in the flat face 40, which represent the ends of the respective wire tracks inside the housing.

Referring now again to FIG. 1, upper jaw 50 of the crimping and shearing tool has a first downward protrusion 52 that will create a first strain relief by engaging first recess 32 of the connector. Near its longitudinal center it has a second downward protrusion 54 that will engage second recess 34 at the longitudinal center of the connector. Near its forward end, the jaw 50 has a third downward protrusion 56 that will drive the metal contacts 36 down. The tool is provided with a closing mechanism, shown only schematically in FIG. 6, for moving the upper jaw 50 downward in exact parallel relation to the longitudinal axis of the housing 22 of connector 20. On the forward end of jaw 50 is a shearing blade 60 that will wipe the flat face 40 of the connector when the jaw is closed.

FIG. 1 also shows, in dotted lines, that a portion of the cable insulation 12 is inserted into the input end of the connector, underneath the first recess 32, and then the wires lay out flat in a laterally spaced arrangement. The wire ends 16 extend through openings 44 in face plate 38, and the orientation of the upper jaw 50 of the crimping and shearing tool is such that its shearing blade 60 will pass over the face 40 of that face plate for shearing off the wire ends.

When the upper jaw of the tool comes down, the first protrusion 52 causes the plastic material of the connector to deform so as to squeeze the full thickness of cable 10, including its insulation 12. The second protrusion 54 comes down where the wires have already been laid flat, and hence presses on the individual insulations of the individual wires. The purpose of the third protrusion 56 is to drive down the metal contacts 36, not shown in FIG. 1, but which are shown in FIGS. 5, 6, 8, and 9.

Figure 2:
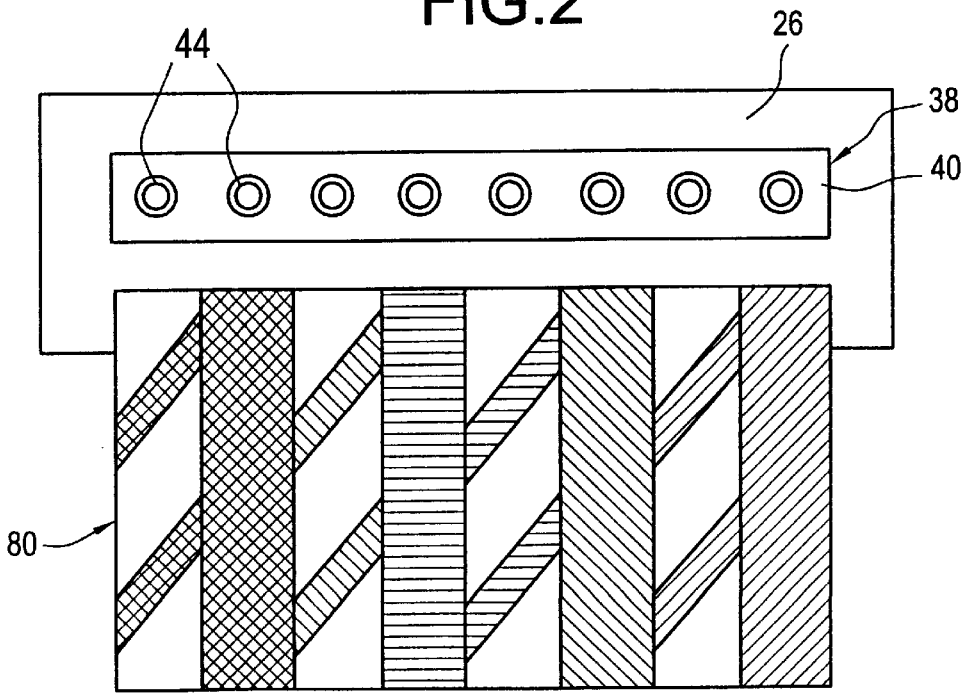
FIG. 2 is an end elevation view taken on line 2—2 of FIG. 1, showing how the protruding wire ends may be compared to a color standard before they are cut.

Also shown in FIG. 2 is a color comparison member 80, which is in the form of a flat rectangular board having eight different color stripes on its upper surface. Before applying a downard force to crimp and cut off the wire ends, the technician can visually compare the colors of the wire ends with the corresponding colors on the comparison board, as best indicated in FIG. 2. If identifying symbols other than colors are used for the wires, then the comparison board 80 will carry a set of such symbols.

Figure 8:
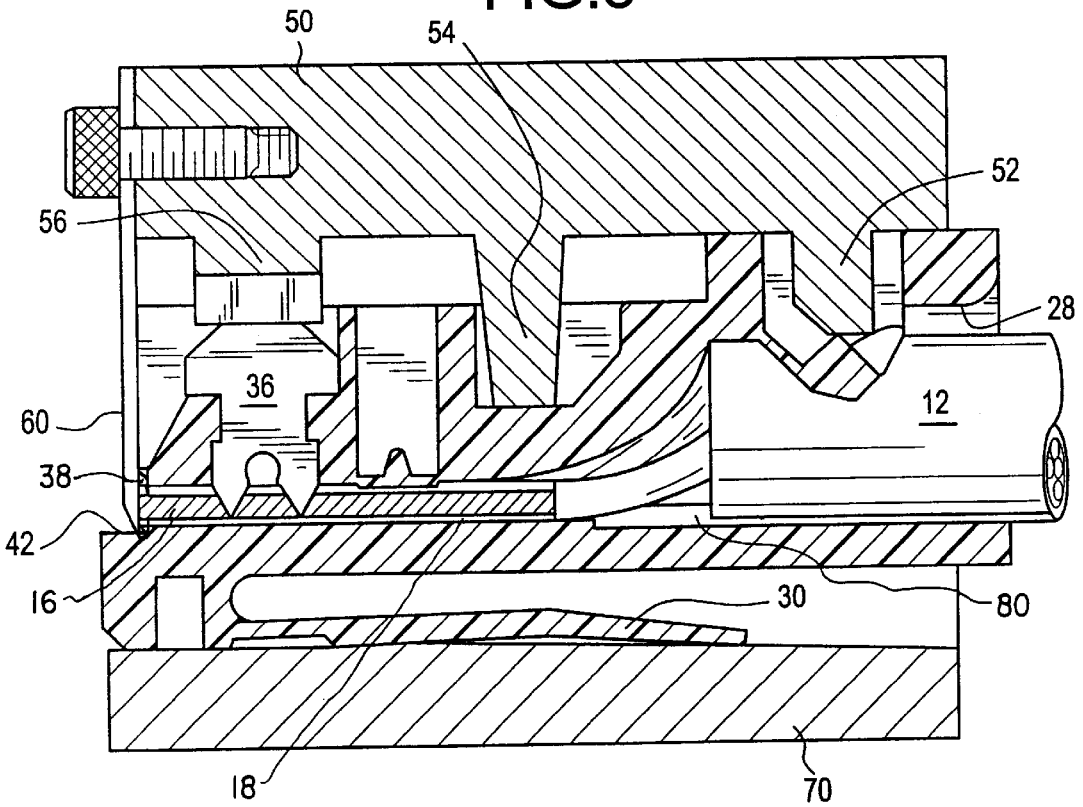
FIG. 8 is a vertical cross-sectional view taken on the line 8—8 of FIG. 7.
Figure 9:
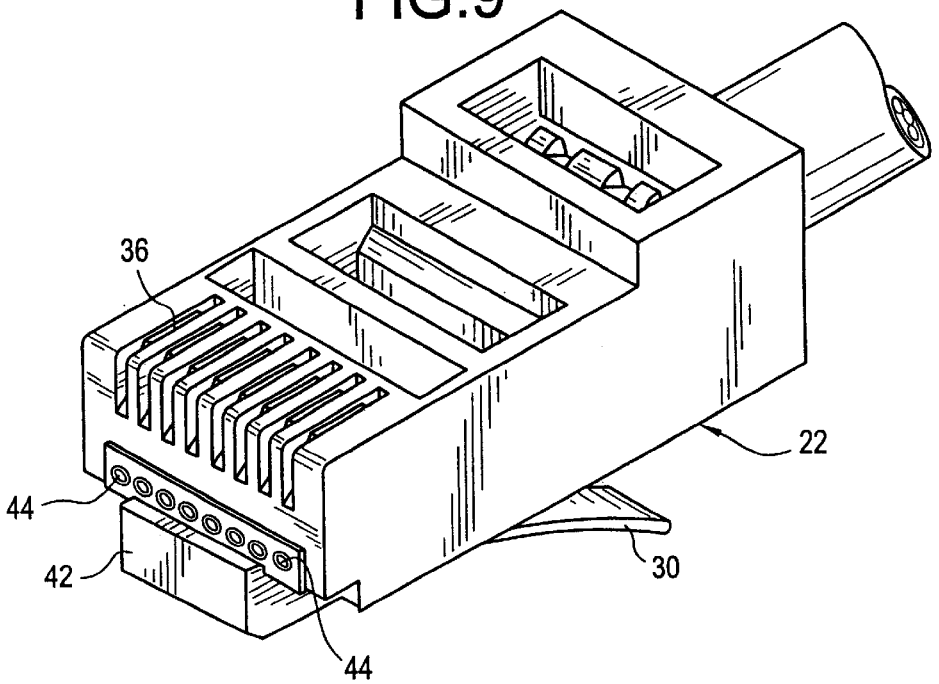
FIG. 9 is a perspective view of my novel connector by itself after the protruding wire ends have been cut off.

Thus, the housing has means for guiding the insulated wires when inserted into its input opening 28 so that all of the wire ends occupy a straight flat configuration, as is well known in the art. According to the invention, the wires will also protrude from its output end in a substantially flat configuration. Although FIG. 8 shows only one such track for guiding one of the insulated wires, it will be understood that there are in fact eight parallel tracks leading to the row of eight output openings 44. The housing is also adapted in response to the crimping action to support the insulated wires against longitudinal stress, as is conventional in such connectors.

Furthermore, the housing 22 at its output end 26 has a flat face 40 that is substantially perpendicular to the output end openings of the parallel separate tracks 44 for guiding the shearing blade 60 to cut off the protruding ends of the wires. Below the flat face portion 40 is a horizontal anvil surface 42, formed as an end portion of the control tab 30, to halt downward movement of the wire ends when the shearing blade pushes them downward, and to ensure shearing of the wires at that point.

Figure 6:
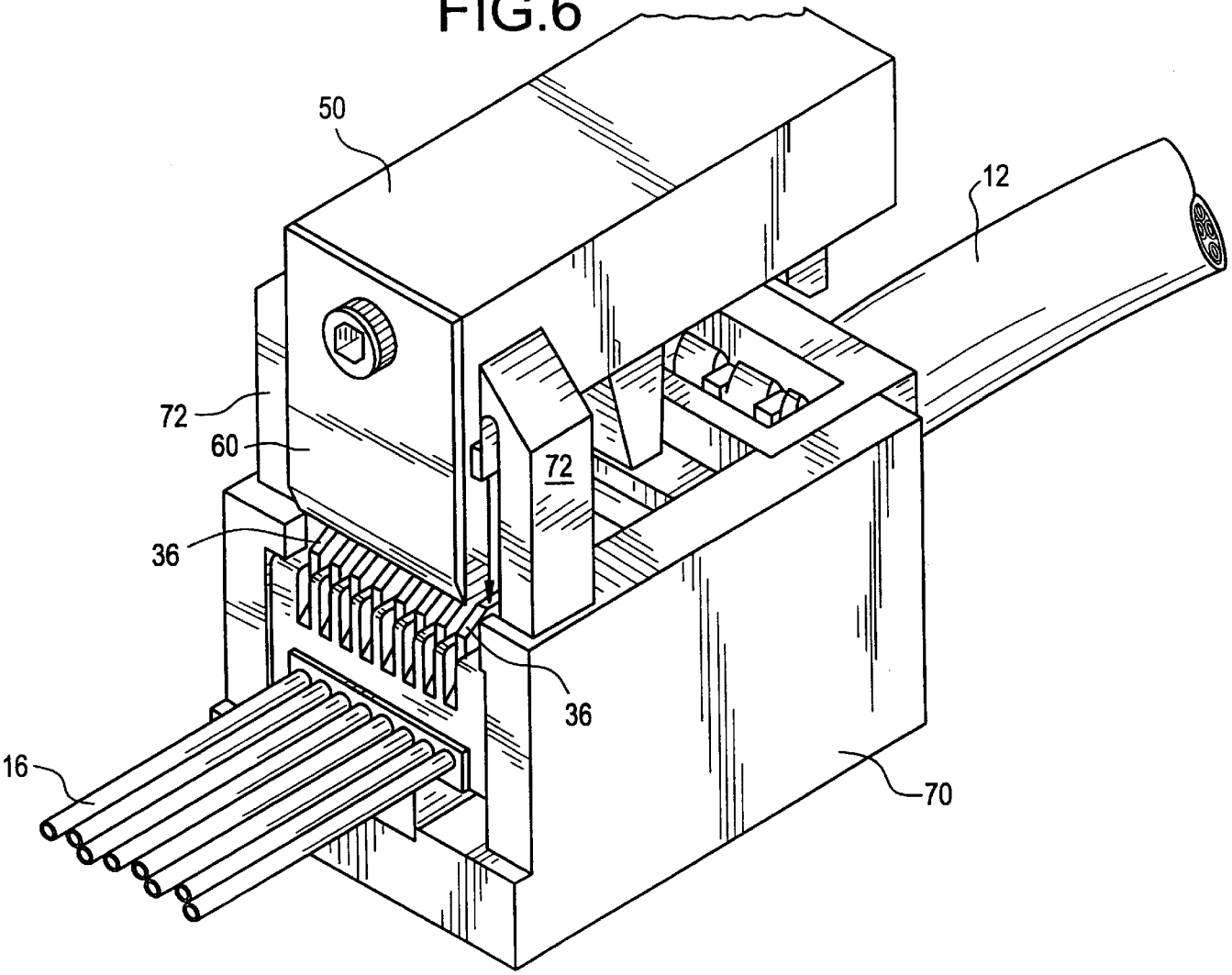
FIG. 6 is a perspective view of the novel connector of FIG. 5 after the straightened cable wires have been inserted through it, and one type of crimping and shearing tool that may be used to cut them off.
Figure 7:
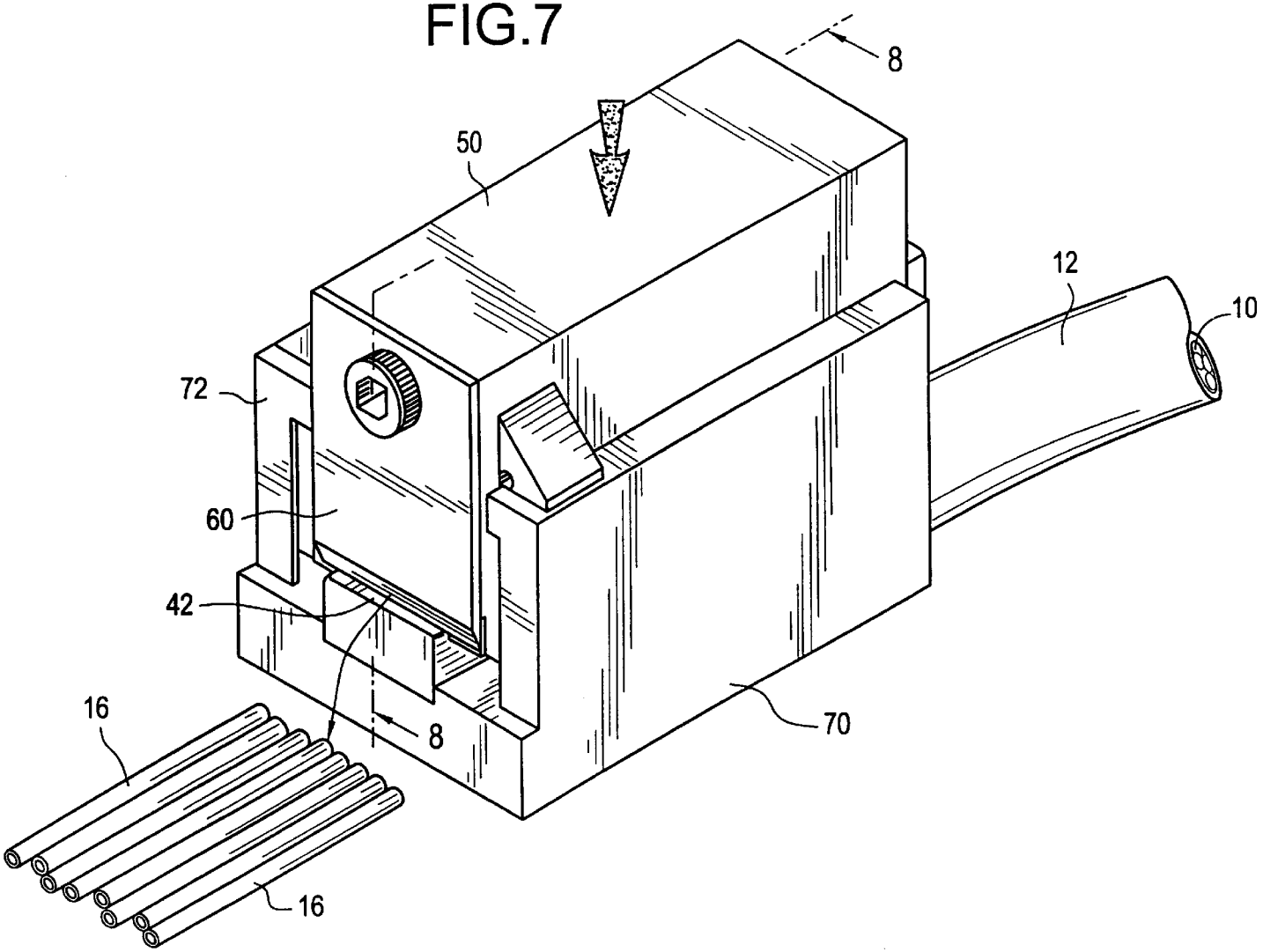
FIG. 7 is a view like FIG. 6, showing the crimping and cutting tool in a closed position and the ends of the wires after they have been cut off.

As shown in FIG. 6, according to the invention a crimping tool, in addition to the upper jaw 50, also has a lower jaw 70 for holding the connector from its under side for positioning the connector in a predetermined position relative thereto. Guide posts 72 guide the downward movement of the upper jaw 50, for crimping the connector housing 22 to support the insulated wires therein against longitudinal stress and also for causing the metal contacts 36 in the connector to pierce insulation coverings of and conductively engage respective wires in the connector. Various different designs of the crimping and shearing tool may use different mechanisms for guiding the closing action of the jaws, as is well known in the art.

The present invention reduces the working time of the technicians. It also makes it possible for a person with less skill to do the job, because of symbol code comparison, pulling the wires through, plus being able to work with longer length of wire. In prior art, it was necessary to cut off the wires too short, then put them into the connector. With the present invention, the technician has conveniently long wires to work with, and can easily see what he is doing before cutting off the ends. This reduces the need for a circuit tester, because of much lower risk of error in connecting the wires. It also saves material by minimizing the need to throw away incorrectly wired connectors.

Although the present invention has been illustrated with regard to a cable having eight wires providing four pairs, it will be understood that the invention will apply to any cable having two or more wire pairs.

The anvil may be of lesser length than the row of holes 44, as shown, or may be of equal or greater length. Further, although the anvil surface 42 is presently formed as an end portion of the control tab 30, it may if desired be provided as part of the lower jaw 70.

Although the presently preferred form of the invention has been disclosed in detail in order to comply with the patent laws, it will be understood that the scope of the invention is to be judged only in accordance with the appended claims.

What I claim is:

1. Portable electrical apparatus useful in telephony and data applications for connecting insulated wires of a multi-pair electrical cable to an outlet, the apparatus comprising:

a connector having a housing with input and output ends, an opening through the housing for receiving a plurality of insulated wires in an essentially flat parallel configuration, crimpable means for supporting the insulated wires in the connector against longitudinal stress, and a plurality of metal contacts supported within the connector in a perpendicularly movable relation to the insulated wires;

the opening in the connector housing being adapted to allow the ends of the insulated wires to protrude from its output end;

a crimping tool having a pair of jaws, means on one of the jaws for positioning the connector in a predetermined position relative thereto, and means on the other jaw operable when the jaws are closed both for crimping the connector to support the insulated wires therein against longitudinal stress and for causing a plurality of the metal contacts in the connector to pierce insulation coverings of and conductively engage respective wires in the connector;

the connector housing further having on its output end a flat end face plate generally perpendicular to the longitudinal axis of the housing, and an anvil supported from the output end of the housing below and generally perpendicular to the flat end face plate; and a cutting blade supported on the other jaw of the crimping tool and operable when the jaws are closed for moving in a transverse direction across the flat end face plate of the connector against the anvil so as to cut off wires that protrude from the end of the connector.

2. Electrical apparatus useful in telephony and data applications for connecting to an outlet the insulated wires of a multi-wire-pair electrical cable, comprising:

a connector having a plastic housing with a rearward end having an input opening and a forward end with an output opening, the input opening being adapted to receive a plurality of insulated wires which may be inserted longitudinally into and through the housing in an essentially flat parallel configuration, and the interior of the housing having parallel tracks such that respective wires may then extend along respective separate tracks with their end portions protruding from the output opening at the forward end of the housing;

the connector housing having near its rearward end a first recess adapted for receiving a crimping force, and at about its longitudinal center a second recess for receiving a crimping force;

a plurality of metal contact plates supported in the housing near its forward end in spaced parallel relation to each other and in perpendicularly movable relation to the tracks that will become occupied by the insulated wires;

a crimping and shearing tool having an upper jaw with first and second downward protrusions to engage the respective recesses in the connector housing, and a third protrusion to drive the metal contact plates down;

the housing being crimpable, and in response to a crimping action being adapted to then support the insulated wires against longitudinal stress and to cause the metal contacts to pierce the insulation coverings of and conductively engage respective wires;

the housing further having on its forward end a flat end face plate generally perpendicular to the longitudinal axis of the housing, and an anvil supported from the forward end of the housing below and generally perpendicular to the flat end face plate; and the crimping and shearing tool having on the forward end of the upper jaw a shearing blade that will wipe the flat end face plate of the housing and engage the anvil when the jaw is closed.

* * * * *